United States Patent [19]

Tanaka et al.

[11] 4,424,762

[45] Jan. 10, 1984

[54] COATING APPARATUS

[75] Inventors: Yasunori Tanaka; Shinji Noda; Hiroshi Chikamasa, all of Kanagawa, Japan

[73] Assignee: Fuji Photo Film Co., Ltd., Minami-ashigari, Japan

[21] Appl. No.: 320,034

[22] Filed: Nov. 10, 1981

[30] Foreign Application Priority Data

Nov. 13, 1980 [JP] Japan ..... 55/159899

[51] Int. Cl.[3] ..... B05C 5/02

[52] U.S. Cl. ..... 118/410

[58] Field of Search ..... 118/410, 411, 407

[56] References Cited

U.S. PATENT DOCUMENTS

| | | | |
|---|---|---|---|
| 2,309,981 | 2/1943 | Randall | 118/410 |
| 2,956,494 | 10/1960 | Tyler et al. | 118/410 X |
| 3,486,482 | 12/1969 | Hunger | 118/413 X |
| 3,556,832 | 1/1971 | Park | 118/410 X |
| 4,023,526 | 5/1977 | Ashmus et al. | 118/410 |
| 4,142,010 | 2/1979 | Pipkin et al. | 118/410 X |

FOREIGN PATENT DOCUMENTS

| | | | |
|---|---|---|---|
| 1455540 | 11/1976 | United Kingdom | 118/410 |

*Primary Examiner*—John P. McIntosh

*Attorney, Agent, or Firm*—Sughrue, Mion, Zinn, Macpeak and Seas

[57] ABSTRACT

An extrusion type coating apparatus for applying a coating film to a support has a bent doctor edge made of cemented carbide having a very large hardness. The bent doctor edge has a very large obtuse angle and the resulting doctor edge allows the coating film to be applied smoothly to the support. Since the doctor edge is made of cemented carbide having a very high hardness, the doctor edge is not unduly worn by abrasives contained in the coating film thereby improving the wear-resistance of the apparatus.

14 Claims, 5 Drawing Figures

COATING APPARATUS

BACKGROUND OF THE INVENTION

This invention relates to a coating apparatus. Specifically, the present invention is an improved extruder for extruding a coating onto a support.

The term "support" as used herein is intended to mean a flexible belt-shaped material 0.3 to 3 m in width, 45 to 10,000 m in length and 5 to 200 mm in thickness, which is made of either a plastic film of polyethylene terephthalate, polyethylene-2, 6-naphthalate, cellulose diacetate, cellulose triacetate, cellulose acetate prpionate, polyvinyl chloride, polyvinylidene, polycarbonate, polyimide or polyamide; paper; paper on which a-polyolefin having two to ten carbons such as polyethlene, polypropyrene or ethylene butane copolymer is coated or laminated; or metal foil or aluminum, copper or tin. The support includes a belt-shaped material which is obtained by forming a preliminary treatment layer on the aforementioned belt-shaped material.

Samples of coating solutions include a photographing photosensitive solution, a magnetic solution, a surface protecting solution, a charging preventing solution or a smoothing solution. The particular solution extruded onto the surface of the support depends upon the use intended. After the coating solution dries, the coated support is cut into pieces having a desired width and length. Typical products of the support are photographing films, print paper and magnetic tapes.

Japanese Patent Application Laid-Open No's 138036/1975 and 90350/1978 disclose extruders with doctor edges which can apply an extremely small and uniform thickness coating solution to a support which is run at a high speed, the speed being between 50 and 100 m/min.

A common feature of these extruders is that the support is laid in such a manner as to be able to bend in the direction of its thickness between support guiding means such as guide rollers. Another common feature is that protruded surfaces of a doctor edge and a back edge, which form a part of the front end portion of the extruder where a slot outlet for extruding the coating solution is formed, confront the support in such a manner so as to abut against the surface of the support. In addition, the distance between the support and the doctor edge provided on the downstream side of the support is changed according to the quantity of supply of extrusion of the coating solution extruded through the slot when carrying out the coating operation.

In the former Japanese Patent Application Laid-Out No. 13803/1975, the doctor edge has a long edge length, and the edge surface is a curved surface having a large curvature, a polygonal surface, an uneven surface, or a completely flat surface. The doctor edge thus formed is confronted with the surface of the support. Therefore, if the section of the doctor edge is not uniformly machined and finished also in the widthwise direction of the support, then the thickness of the coated film is unavoidably considerably non-uniform in the widthwise direction. Accordingly, in machining the doctor edge, high machining precision is required, and a material for manufacturing the doctor edge is limited.

Recently, there has been a strong demand for a coated film more uniform in thickness. However, in the case of the doctor edge having the above-described edge surface, the ends of the doctor edge or the parts in the vicinity thereof which greatly affect the surface quality, thickness, etc. of the coated film are not precisely straight because the ends of the doctor edge are rounded or chamfered to remove burrs. Therefore, the extruder is limited in controlling the thickness of the coated film in the order of micrometers (μm).

Even if it were possible to machine and finish the ends of the doctor edge in the order of micrometers, the surface and ends of the doctor edge would be readily worn, because when coating, the doctor edge is often kept in contact for a long time with a coating solution containing a relatively large quantity of relatively hard and minute foreign particles such as ferromagnetic iron oxide powders, silver halogenide particles and abrasive particles. Therefore, it is necessary to correct the portions of the doctor edge worn by abrasion. The accuracy of the coated finish is greatly lowered whenever abrasion occurs.

In the latter Japanese Patent Application Laid-Out No. 90350/1978, the doctor edge also has a flat surface and rounded or chamfered ends. In addition, a protruded surface of the back edge located on the upstream side of the support with respect to the slot outlet contacts the surface of the support. Therefore, as in the former extruder referred to above, it is difficult to provide a coated film uniform in thickness and satisfactory in surface quality.

Furthermore, both of these prior art extruders are disadvantageous in that, as the quantity of the above-described abrasive particles is increased, defects such as longitudinal stripes are liable to be formed which degrade the product quality.

In the case where the doctor edge has a flat surface, the coated surface can be readily improved in accuracy. However, since the doctor edge has an upstream edge and a downstream edge, one of these two edges pushes the support surface more forcefully than the other edge resulting in the doctoring operation on the flat surface being non-uniform. As a result, the tension of the support is abruptly varied (increased) at the end pushing more forcefully and accordingly it is difficult to form a coated film having a desired thickness, and the aforementioned longitudinal stripe defects are frequently formed.

SUMMARY OF THE INVENTION

Accordingly, an object of the present invention is to provide a coating apparatus in which all of the above-described difficulties accompanying the prior art coating apparatus are eliminated, and machining and maintenance of the doctor edge can be readily achieved.

The foregoing object and other objects of the invention are achieved by the provision of an extrusion type coating apparatus in which a coating solution is continuously extruded out of an open end of a slot which is set close to the surface of a belt-shaped flexible support running continuously along a predetermined running path. The coating solution is applied to the surface of the flexible support while the amount of coating solution applied to the support is metered to a desired thickness by a doctor edge adjacent to the slot. The doctor edge has a doctor surface bent towards the support so that the doctor edge is triangular in section, the doctor edge being set close to the support in such a manner that the support is bent substantially triangular, therefore metering the amount of coating solution applied.

DESCRIPTION OF THE PREFERRED EMBODIMENTS

Figure 1:
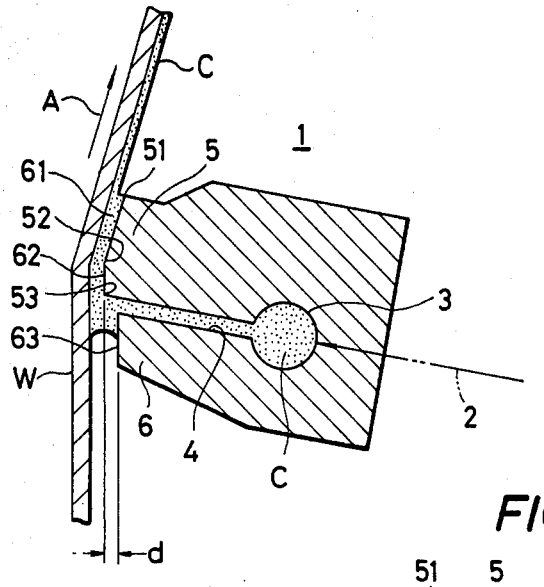
FIGS. 1 and 2 are sectional views of an extruder of a coating apparatus according to the present invention.
Figure 2:
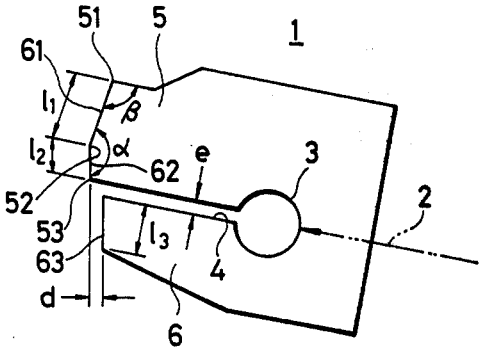
Figure 3:
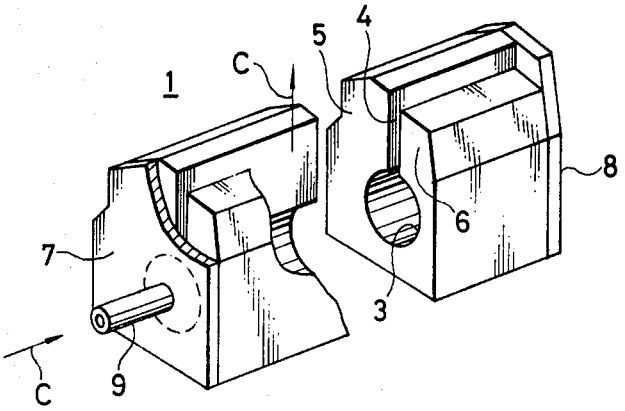
FIG. 3 is a perspective view, with parts cut away, showing the extruder in FIGS. 1 and 2.

FIGS. 1–3 show a first embodiment of the coating apparatus of the present invention. The extruder 1 includes a solution supplying system 2, a pocket 3, a slot 4, a doctor edge 5, and a back edge 6.

The solution supplying system 2 comprises pump means (not shown) which is provided outside the body of the extruder 1 for continuously supplying a coating solution C at a predetermined flow rate. The pump means communicates via pipe members with the pocket 3 which extends in the body of the extruder 1 in the widthwise direction of a support W.

The pocket 3 is substantially circular in cross-section as shown in FIGS. 1–3. The pocket 3 extends in the widthwise direction of the support W with the sectional configuration being substantially unchanged. That is, the pocket 3 is a kind of solution pool. The effective length of the pocket 3 is, in general, equal to or slightly longer than the coated width to be applied to the support W.

The inside diameter of the pocket 3 is generally in a range of from 10 mm to 50 mm. Both open ends of the pocket 3 are closed by shield plates 7 and 8 which are secured to both end faces of the extruder 1.

A short pipe 9 extends from the shield plate 7. The solution supplying system 2 is connected to the short pipe 9 so that the pocket 3 is filled with the coating solution C by the pump means. The coating solution C is extruded from the pocket 3 through the slot 4 under a uniform solution pressure distribution.

The slot 4 is provided in the body of the extruder 1 from the pocket 3 towards the support W. The slot 4 usually has a width e between 0.03 and 2 mm. The slot 4 is a relatively narrow flow path which extends in the widthwise direction of the support W as in the case of pocket 3. The length of the opening of the slot 4 in the widthwise direction is substantially equal to the coating width of the support W.

The length of the flow path in the slot 4 extending between the pocket 3 and support W is determined by taking into consideration various conditions such as the composition and properties of the coating solution C, and a flow rate and a pressure in supplying the coating solution C. That is, the length of the flow path between the pocket 3 and the support W is determined so that the coating solution C flows in the form of a layer out of the pocket 3 with the flow rate and solution pressure distribution being uniform in the widthwise direction of the support W.

At the end portion of the body of the extruder 1, where the slot 4 is open, a step d is formed by the doctor edge 5 and the back edge 6.

The doctor edge 5 is provided on the downstream side of the support W with respect to the opening of the slot 4. The doctor edge is closer, usually by 0.01 to 1.0 mm, to the support W than the back edge 6 which is provided on the upstream side of the support W, thus forming the aforementioned step d.

The doctor edge 5 has edge surfaces 61, 62 which confront the support W. The edge surfaces 61, 62 consist of two surfaces which form a vertical angle $\alpha$ which is an obtuse angle of 165° or larger, preferably 170° to 178°. One of the two surfaces, surface 61, which is on the downstream side of the vertical angle $\alpha$ has a length $l_1$ of 1 to 15 mm, preferably 1 to 5 mm.

The surface 62 on the upstream side of the angle $\alpha$ has a length $l_2$ between 0.1 and 2 mm, the length $l_2$ preferably being between 0.1 and 1 mm.

The edge surfaces 61 and 62 of the doctor edge 5 are made of a cemented carbide material having a hardness of about 70 or larger (in Rockwell hardness A scale) in order to dispense with the aforementioned rounding or chamfering thus improving the wear-resisting characteristics of these surfaces 61,62.

The back edge 6 has an edge surface 63 which is substantially parallel with the edge surface 62 of the doctor edge 5. The edge surface 63 of the back edge 6 confronts the support W with the step d as described above. The edge surface 63 of the back edge 6 has a length between 1 and 5 mm, preferably being between 1 and 3 mm.

The doctor edge 5 has an edge 51 on the downstream side of the vertical angle $\alpha$, and an edge 53 on the upstream side of the vertical angle $\alpha$. A top edge 52 is located between the edges 51 and 53. The edges 51, 52 and 53 are not rounded nor chamfered; i.e., they are not machined at all. The edges 51 and 53 merge with sides which are extended away from the support W, forming an angle $\beta$ of about 70 to 90 degrees with the aforementioned two surfaces, respectively.

In the coating apparatus thus constructed, the support W is laid over running and guiding means such as guide rollers (not shown) in such a manner that the support W is under a substantially constant tension and is slightly curved in the direction of its thickness. When the support W thus laid is caused to approach the doctor edge 5 by an extruder supporting mechanism (not shown) so that the support W is curved and is substantially parallel with the downstream surface 61 of the doctor edge 5, the solution supplying system 2 starts supplying the coating solution C at a desired flow rate. The coating solution C is extruded through the pocket 3 and the slot 4 at a uniform flow rate and with a uniform pressure distribution.

The coating solution C is delivered to the opening of the slot 4 and partially flows onto the edge surface 63 of the back edge 6 which confronts the support W with a small gap corresponding to the aforementioned step d to form a kind of bead in the gap. The coating solution flows along the surface of the support W which is moving continuously in the direction of the arrow A in such a manner as to push the support W away from the edge surfaces 61, 62 of the doctor edge 5.

As the above-described movement of the coating solution is continued, the support W is spaced a constant distance apart from the edge surfaces 61, 62 of the doctor edge 5 by the coating solution which flows in the form of a layer over the width of the support W.

The constant distance between the support W and the edge surfaces 61,62 of the doctor edge 5 depends on various conditions, such as the tension of the support W, the distance between the support W and the extruder 1 and the flow rate of the coating solution C. If, among these conditions, the flow rate of the coating solution C is controlled, the separation distance between the support W and the edge surface 61,62 of the doctor edge 5, i.e., the thickness of the coated film, can be determined readily and accurately.

As was described before, the edge surfaces 61,62 of the doctor edge 5 consists of the upstream and the downstream surfaces 61,62 which form the obtuse angle $\alpha$, and the entire edge surfaces 62,61 are made of the cemented carbide material. Therefore, the upstream and downstream surfaces 62,61 are very straight and the surfaces merging therewith are very flat. Furthermore, as the length $l_1$ of the downstream surface 61 is made longer than the length $l_2$ of the upstream surface 62, the bending of the support W is minimized. The doctoring operation carried out between the edge surfaces 61, 62 of the doctor edge 5 and the support W is effected smoothly and the coated film is more uniform in thickness in the widthwise direction. Not only is extreme bending of the support W prevented, but a wedge effect also results facilitating a high speed coating operation generated around the upstream surface 62.

Figure 4:
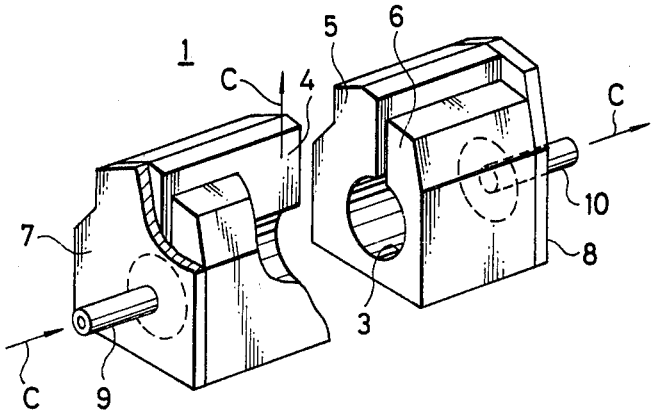
FIGS. 4 and 5 are perspective views showing modifications of a method of supplying a coating solution to the extruder in the coating apparatus of the present invention.
Figure 5:
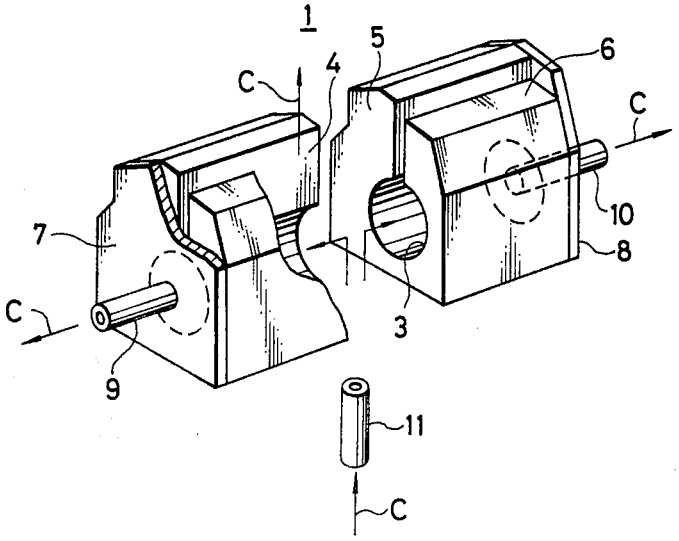

FIGS. 4 and 5 show modifications of the above-described method of supplying the coating solution C to the pocket 3.

In the modification shown in FIG. 4, as in the method shown in FIG. 3, the coating solution is supplied from one side of the extruder. However, it should be noted that another short pipe 10 is mounted on the other shield plate 8, so that a part of the coating solution C injected into the pocket 3 through the one short pipe 9 on the one shield plate 7 is discharged through the short pipe 10 to thereby prevent the coating solution C from being retained in the pocket 3 for a long time. This is considerably important in applying a magnetic coating solution which is thixotropic and condensable.

An extruder shown in FIG. 5 can be obtained by adding a third short pipe 11 to the extruder shown in FIG. 4. That is, the extruder in FIG. 5 has the short pipe 11 in addition to short pipes 9 and 10 provided on both plates 7, 8. The short pipe 11 communicates withe substantially central portion of the pocket 3. That is, the extruder has a central supply system in which the coating solution C is supplied through the central short pipe 11.

A part of the coating solution C injected into the pocket 3 is discharged through short pipes 9 and 10 and the remaining coating solution C is extruded through the slot 4 with more uniform pressure distribution without being retained in the pocket 3.

The coating solution supplying methods for the coating apparatus according to the invention have been described with references to FIGS. 3–5, respectively; however, these methods may be employed in combination. The cylindrical pocket 3 has been described; however, it may be a rectangular pocket, i.e., a ship's bottom-shaped pocket. That is, any pocket may be employed if it is so shaped as to make the solution pressure distribution uniform in the widthwise direction of the support W.

Furthermore, the coating characteristics can be maintained satisfactory even if the body of the extruder except for the doctor edge 5 is not made of a cemented carbide material, i.e., the block member forming the back edge 6, the slot 4 or the pocket 3.

The above-described coating apparatus of the invention provides the following novel effects or merits;

At least the doctor edge 5 of the extruder 1 is made of the cemented carbide material. The doctor edge 5 has the edge surfaces 61,62 of two surfaces forming the obtuse angle $\alpha$. The downstream edge 51, the top edge 52 and the upstream edge 53 of the doctor edge 5 are not chamfered at all, and these edges and the upstream and downstream surfaces 62,61 of the doctor edge 5 are remarkably improved in wear resistance. This eliminates any loss in the coating accuracy due to repolishing.

The upstream and downstream surfaces 62,61 forming the edge surface of the doctor edge 5 form the obtuse angle $\alpha$.

The extruder 1 is confronted with the surface of the support W so that the support W is bent substantially parallel with the downstream surface 61 of the doctor edge 5. Therefore, problems which result when the support W is extremely bent are avoided. Accordingly the thickness of the coated film is not varied and longitudinal strips formed by abnormal tension variations are also avoided.

As described above, the doctor edge 5 is triangular in section. Therefore, a wedge effect results and the coating solution C is more smoothly and positively applied to the support W near the upstream edge of the upstream surface 62. Accordingly, a high speed coating operation can be carried out with the coating apparatus of the present invention.

The edge surface of the back edge 6 is retracted by the step d from the prolongation of the upstream surface 62 of the doctor edge 5. Therefore, contact between the extruder and the support surface W is prevented or minimized. Accordingly, degradation of the coated film surface quality due to the unsatisfactory surface quality of the support W, such as a scratched surface, can be prevented.

The coating apparatus according to the invention has been tested as follows.

Materials listed in Table 1 were sufficiently mixed and dispersed in a ball mill, and epoxy resin (epoxy equivalent 500) of 30 parts by weight was added to the resultant mixture. The resultant solution was uniformly mixed and dispersed to obtain a magnetic coating solution.

TABLE 1

| | |
|---|---|
| $\gamma$-Fe203 powder (needle particles having an average major diameter of 0.5μ, 320 Oe) | 300 parts by weight |
| Vinyl chloride - vinyl acetate copolymer (copolymerization ratio 83:13, copolymerization degree 400) | 30 parts by weight |
| Electrically conductive carbon | 20 parts by weight |
| Plyamide resion (Amine value 300) | 15 parts by weight |
| Lecithin | 6 parts by weight |
| Silicon oil (Dimethylpolysiloxane) | 3 parts by weight |
| Xylole | 300 parts by weight |
| Methylisobutylketone | 300 parts by weight |
| N—butanol | |

The equilibrium viscosity of the magnetic coating solution thus prepared was measured with a "Shimazu Rheometer RM-1" manufactured by the Shimazu Seisakusho. It was 8 P (poise) with a shearing speed of 10 sec.$^{-1}$, and was 1 P with a shearing speed 500 sec.$^{-1}$.

The coating solution was applied with the coating apparatus as shown in FIGS. 1–3, under the following conditions. (No chamfering was carried out.)

(1) Support
Material—Polyethylene terephthalate film
Thickness—20 μm
Width—300 mm
Tension—2 kg/full width, and 4 kg/full width
Moving Speed—50 m/min., and 100 m/min.
(2) Extruder
Doctor edge material—SUS-27 and cemented carbide
Doctor edge hardness—SUS-27: (60 or less in Rockwell hardness A scale); and cemented carbide: (88 or larger in Rockwell hardness A scale)
Doctor edge
Obtuse angle (α)—160, 165, 170, 178, and 180 degrees
Downstream surface length ($l_1$)—0.5, 1, 10, 15 and 16 mm
Upstream surface length ($l_2$)—0.05, 0.1, 1, 2 and 3 mm
Back edge
Edge surface length ($l_3$)—0.05, 1, 5 and 6 mm
Step (d)—0.01, 0.5, 1 and 1.5 mm
(3) Coated film thickness (after dried)—2 μm and 10 μm
(4) Coating time (in total)—500 hours As a result, the following could be confirmed:

(1) The extruder made of SUS-27 was worn in about fifty hours to the extent that the coated film thickness was greatly changed. On the other hand, the extruder made of the cemented carbide was scarcely worn even after 500 hours.

(2) In each of the extruders made of SUS-27 unsmoothed partions like burrs were found at both edges, and at the top edge of the bent edge surface of the doctor edge. The reproduction output of the coated film formed by the extruder made of SUS-27 varied.

No defects like burrs were found in any one of the extruders made of the cemented carbide. However, depending on the conditions set for the edges, some coated films were found unsatisfactory in thickness and surface quality.

(a) When the angle (α) was set to 160 degrees, the contact angle of the extruder with the support near the top edge was increased, as a result of which defects such as longitudinal stripes were frequently formed. Thus it was determined unsatisfactory to set the angle to 160 degrees.

When the angle was set to 180 degrees, i.e., the doctor edge was made flat, the contact angle at the upstream edge was increased, as a result of which defects such as longitudinal stripes were frequently formed, while the coated film thickness in the widthwise direction was nonuniform.

(b) When the length ($l_1$) of the downstream surface of the doctor edge was set to 0.5 mm, the aforementioned doctoring action was insufficient, as a result of which the coated film thickness was not uniform. When the length was set to 16 mm, the tension loss of the support increased with the result that the support ran unstably. Thus, it was undesirable to set the length of 0.5 mm or 16 mm.

(c) When the length ($l_2$) of the upstream surface of the doctor edge was set to 0.5 mm, the coating solution was excessively applied to the support. When the length was set to 3 mm, the coating solution was liable to flow in the widthwise direction from the upstream surface. Thus, it was not suitable to set the length to 0.05 mm or 3 mm.

(d) The length ($l_3$) of the edge surface of the back edge and the step d had variable optimum values depending on the contact angles of the support with the doctor edge; however, it was found that satisfactory results were obtained by setting the length ($l_3$) of the edge surface in the range of from 1 mm to 5 mm and by setting the step d in the range of from 0.01 mm to 1 mm.

What is claimed:

1. An extrusion type coating apparatus for continuously extruding a coating solution out of an open end of a slot which is set close to a surface of a belt-shaped flexible support running continuously along a predetermined running path in order to apply said coating solution to the surface of said support, comprising:

a doctor edge adjacent to said slot for metering a desired thickness of said coating solution applied to said support;

said doctor edge having adjacent flat doctor surfaces bent relative to one another along a first edge extending in a widthwise direction of said support, said adjacent doctor surfaces forming an obtuse angle at said first edge which is sufficiently large to enable said running path of said belt-shaped flexible support to be parallel to both said adjacent doctor surfaces, said running path of said belt-shaped flexible support changing direction in a vicinity of said first edge;

said obtuse angle being at least 165°, one of said two adjacent doctor surfaces which is on a downstream side of said support having a length of 1 mm to 15 mm, while the other adjacent doctor surface which is on the upstream side of said support has a length of 0.1 mm to 2 mm.

2. The apparatus claimed in claim 1, wherein said adjacent doctor surfaces are made of cemented carbide having a Rockwell A hardness number of at least 70.

3. The apparatus claimed in claim 1 further comprising a back edge surface located adjacent to the open end of said slot, said back edge surface confronting said support in such a manner that said back edge surface is retracted further from said support than is said adjacent doctor surface on said upstream side of said support to form a step with said adjacent doctor surface on the upstream side of said support.

4. The apparatus claimed in claim 3 wherein said back edge surface has a length of 1 mm to 5 mm and said step has a length of 0.01 mm to 1.0 mm.

5. The apparatus claimed in claim 4 further comprising pocket means for supplying said coating solution to said slot, said pocket means having a length at least so long as a width of said support being coated;

and a pipe at one end of said pocket means for supplying said coating solution to said pocket means.

6. The apparatus claimed in claim 5 further comprising a second pipe located at the other end of said pocket means for discharging said coating solution.

7. The apparatus as claimed in claim 4 further comprising pocket means for supplying said coating solution to said slot, said pocket means having a length at least as long as a width of said support being coated; and first, second and third pipes, said first and second pipes being located at opposite side end faces of said pocket means and said third pipe being located at a central part of a side surface of said pocket means which interconnects said opposite side end faces, said third pipe supplying coating solution to said pocket means, and said first and second pipes discharging coating solution from said pocket means.

8. The apparatus claimed in claim 5 or 7 wherein said pocket means is circular in cross-section.

9. The apparatus claimed in claim 5 or 7 wherein said pocket means has a rectilinear shape.

10. The apparatus claimed in claim 3 wherein said back edge surface is parallel to said upstream side doctor surface.

11. The apparatus claimed in claim 10 wherein said back edge surface is retracted a distance between 0.01 and 1.0 mm further from said support than said upstream side adjacent doctor surface.

12. The apparatus claimed in claim 3 wherein said upstream side and said downstream side adjacent doctor surfaces have second and third edges, respectively, displaced from said first edge, said back edge surface having a fourth edge opposite said second edge of said upstream adjacent doctor surface, said first, second, third and fourth edges being substantially parallel to one another and extending parallel to said widthwise direction of said support, said first, second and third edges being sharp rather than rounded or chamfered edge surfaces.

13. The apparatus claimed in claim 1 wherein said obtuse angle is between 170°–180°.

14. The apparatus claimed in claim 1 wherein said length of said downstream side adjacent doctor surface is between 1 mm and 5 mm, said length of said upstream side adjacent doctor surface being between 0.1 and 1 mm.

* * * * *